US006296555B1

(12) United States Patent
Inaba et al.

(10) Patent No.: US 6,296,555 B1
(45) Date of Patent: Oct. 2, 2001

(54) WAFER MACHINING APPARATUS

(75) Inventors: Takao Inaba; Minoru Numoto, both of Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 0 days.

(21) Appl. No.: 09/420,454

(22) Filed: Oct. 18, 1999

(30) Foreign Application Priority Data

Oct. 19, 1998 (JP) ..... 10-296946

(51) Int. Cl.[7] ..... B24B 1/00

(52) U.S. Cl. ..... 451/282; 451/285; 451/287; 451/289

(58) Field of Search ..... 451/41, 54, 282, 451/285, 286, 287, 288, 289, 339

(56) References Cited

U.S. PATENT DOCUMENTS 5,779,520 * 7/1998 Hayakawa ..... 451/41
6,050,884 * 4/2000 Togawa et al. ..... 451/676
6,086,457 * 7/2000 Perlov et al. ..... 451/41
6,113,465 * 9/2000 Kim et al. ..... 451/41
6,132,289 * 10/2000 Labunsky et al. ..... 451/6

FOREIGN PATENT DOCUMENTS 3-149816 6/1991 (JP) .
4-57663 2/1992 (JP) .

* cited by examiner

*Primary Examiner*—Eileen P. Morgan
(74) *Attorney, Agent, or Firm*—Nixon Peabody LLP; David S. Safran

(57) ABSTRACT

According to the present invention, a floating mechanism of a load stage floats positioned wafers in concave parts, and then, the chucks hold the wafers by suction. Therefore, the chucks can easily hold the centered wafers.

4 Claims, 8 Drawing Sheets

WAFER MACHINING APPARATUS

BACKGROUND OF THE INVENTION

1. Field of the Invention

The present invention relates generally to a wafer machining apparatus, and more particularly to a wafer machining apparatus for machining a semiconductor wafer in a chemical mechanical polishing (CMP).

2. Description of Related Art

A conventional semiconductor wafer machining apparatus is comprised mainly of a polishing part having a turntable, and a load stage. This wafer machining apparatus holds a wafer, which has not yet been machined, in a concave part of the load stage to hereby hold the centered (positioned) wafer. The load stage centers the wafer, so that the wafer can be transferred to the polishing part with the position being a reference and can be polished at a regular position. It is therefore important to center the wafer at the load stage in order to uniformly polish the surface of the wafer.

When the wafer is centered at the load stage, the load stage or a wafer holding part of the polishing part is moved so that they can become closer relatively to one another. The wafer holding part holds the wafer, held on the, load stage, by suction. After the wafer holding part is moved to the turntable, the wafer is polished in the state of being pressed by the wafer holding part against the turntable. That completes the polishing of one wafer.

In the conventional wafer machining apparatus, the wafer holding part holds the wafer, held (contained) in the concave part of the load stage, by suction. Thus, the wafer holding part cannot hold the wafer by suction because the wafer holding part comes into contact with the top of the concave part before holding the wafer by suction.

To solve this problem, the depth of the concave part is smaller than the thickness of the wafer, and the top of the wafer is projected from the top of the concave part. In this case, however, the wafer may be displaced from the concave part.

Therefore, it is preferable to form the concave part with a larger depth than the thickness of the wafer in order to hold the centered wafer. On the other hand, it is preferable to form the concave part with a smaller depth than the thickness of the wafer in order to hold the wafer with a chuck. Thus, there is a conflict between the two ideas.

SUMMARY OF THE INVENTION

In view of the foregoing, it is an object of the present invention to provide a wafer machining apparatus, which is provided with a load stage that is able to easily make a positioned wafer be held by a wafer holding part.

To achieve the above-mentioned object, the present invention is directed to a wafer machining apparatus which comprises a polishing part for polishing a wafer, and a load stage arranged adjacent to said polishing part and having a concave part for holding a wafer which has not been polished while positioning the unpolished wafer, said load stage transferring the wafer from said concave part to a wafer holding part of said polishing part, said wafer machining apparatus wherein: said load stage has a floating means for floating the wafer in said concave part.

According to the present invention, the floating means of the load stage is driven to float the wafer, which is positioned in the concave part, so that the wafer holding part can hold the wafer. Therefore, the wafer holding part can easily hold the positioned wafer.

According to the present invention, the floating means floats the wafer by supplying a liquid to the concave part, so that the wafer can be floated by the liquid. This is more stable than the floating by air.

According to the present invention, the floating means floats the wafer by supplying a mixture of a liquid and a gas to the concave part, so that the wafer can be floated by the mixture. This is more stable than the floating by air. Moreover, the wafer can easily be transferred to the wafer holding part.

According to the present invention, the load stage has cleaning liquid supply means for supplying a cleaning liquid to the top of the wafer floated by the floating means. The cleaning liquid washes away the dust, which is adhered to the top of the wafer, or the dust, which is likely to adhere to the wafer. Therefore, the wafer holding part can hold the clean wafer.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
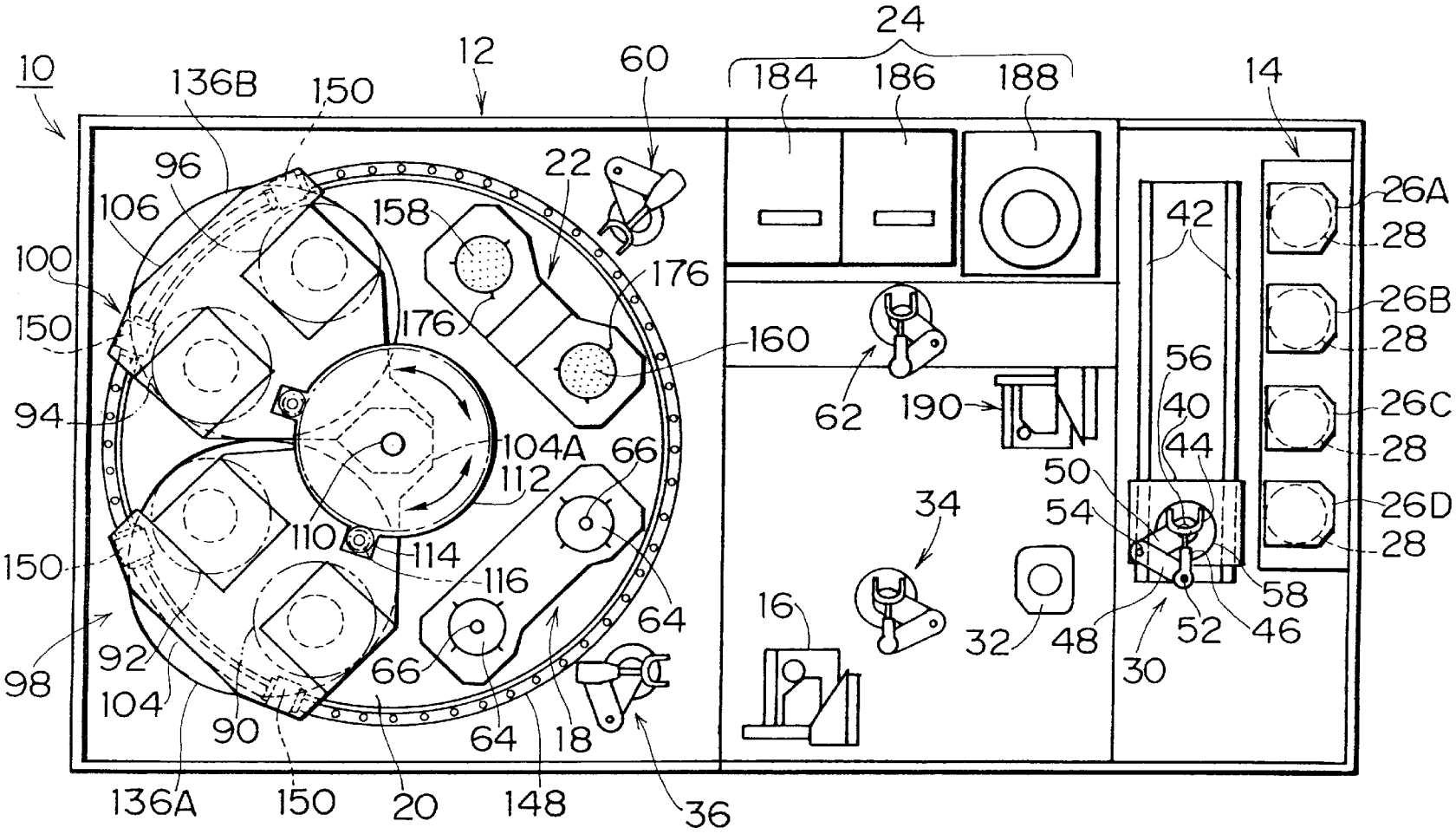
FIG. 1 is a plan view showing a wafer machining apparatus according to an embodiment of the present invention.

FIG. 1 is a plan view showing a wafer machining apparatus 10 according to an embodiment of the present invention.

A cassette mounting part 14, an alignment part 16, a load stage 18, a wafer polishing part 20, an unload stage 22, a wafer cleaning and drying part 24, and the like are provided in a body 12 of the wafer machining apparatus 10 in FIG. 1.

Four cassettes 26A, 26B, 26C, 26D are detachably mounted in the cassette mounting part 14, and the cassettes 26A–26D contain a number of wafers 28, which have not yet machined, indicated by long and short alternate lines in FIG. 1. In this embodiment, the cassette 26A contains dummy wafers coated with oxide films (silicon dioxide film); the cassette 26B contains dummy wafers coated with metal films; the cassette 26C contains wafers coated with oxide films (silicon dioxide film); and the cassette 26D contains wafers coated with metal films. The dummy wafers contained in the cassette 26A are polished in order to check the polishing amount of the wafers contained in the cassette 26C in advance. The dummy wafers contained in the cassette 26B are polished in order to check the polishing amount of the wafers contained in the 5cassette 26D in advance.

A transfer robot 30, which is disposed near the cassettes 26A–26D, picks up the wafers 28 one by one from the cassettes 26A–26D, and then, the wafers 28 are placed on a temporary stage 32. A transfer robot 34 transfers the wafer 28 placed on the temporary stage 32 to the alignment part 16. The alignment part 16 centers (positions) the wafers 28, and measures the thickness thereof. Then, a transfer robot 36 holds the wafers 28 by suction and transfers the wafers 28 one by one to the load stage 18.

The cassettes 26A–26D are placed on a lift table of an elevator (not shown). Driving the elevator adjusts the height of the cassettes 26A–26D. Therefore, the transfer robot 30 can pick up the wafers 28 from predetermined shelves of the cassettes 26A–26D without moving up or down the transfer robot 30. If the transfer robot 30 is provided with an elevation mechanism, there is no necessity of providing the elevator.

A description will now be given of the transfer robot 30. The transfer robot 30 is placed on a table 40. The table 40 is movably mounted on a pair of rails 42, which is parallel to the mounting direction of the cassettes 26A–26D (the vertical direction in FIG. 1). A driving force of a drive part (not shown) moves the table 40 reciprocally along the rails. Thus, the transfer robot 30 moves vertically in FIG. 1 along the rails 42, and moves to such a position as to pick up the wafers 28 from one cassette selected among the cassettes 26A–26D. Then, the transfer robot 30 places the picked-up wafers 28 on the temporary stage 32.

The transfer robot 30 is an all-purpose robot, which is comprised mainly of a horseshoe-shaped arm 44 for holding the wafers 28 and three links 46, 48, 50. The arm 44 is rotatably supported on the link 46, and it can be rotated by a driving force of a motor (not shown). The link 46 rotatably connects to the link 48 through a shaft 52, and it can be rotated about the shaft 52 due to a driving force of a motor (not shown). The link 48 rotatably connects to the link 50 through a shaft 54, and it can be rotated about the shaft 54 by a driving force of a motor (not shown). The link 50 connects to an output shaft (not shown) of a motor 58 through a shaft 56. Running the motor 58 rotates the link 50 about the shaft 56. Thus, the robot 30 picks up the wafers 28 from the cassettes 26A–26D and transfers them to the temporary stage 32 by controlling the operation of the arm 44 and the three links 46, 48, 50 by respective motors.

The transfer robots 34, 36 and later-described transfer robots 60, 62 are constructed in the same manner as the transfer robot 30, and thus, they will not be described here.

A description will now be given of the load stage 18 according to this embodiment.

Figure 2:
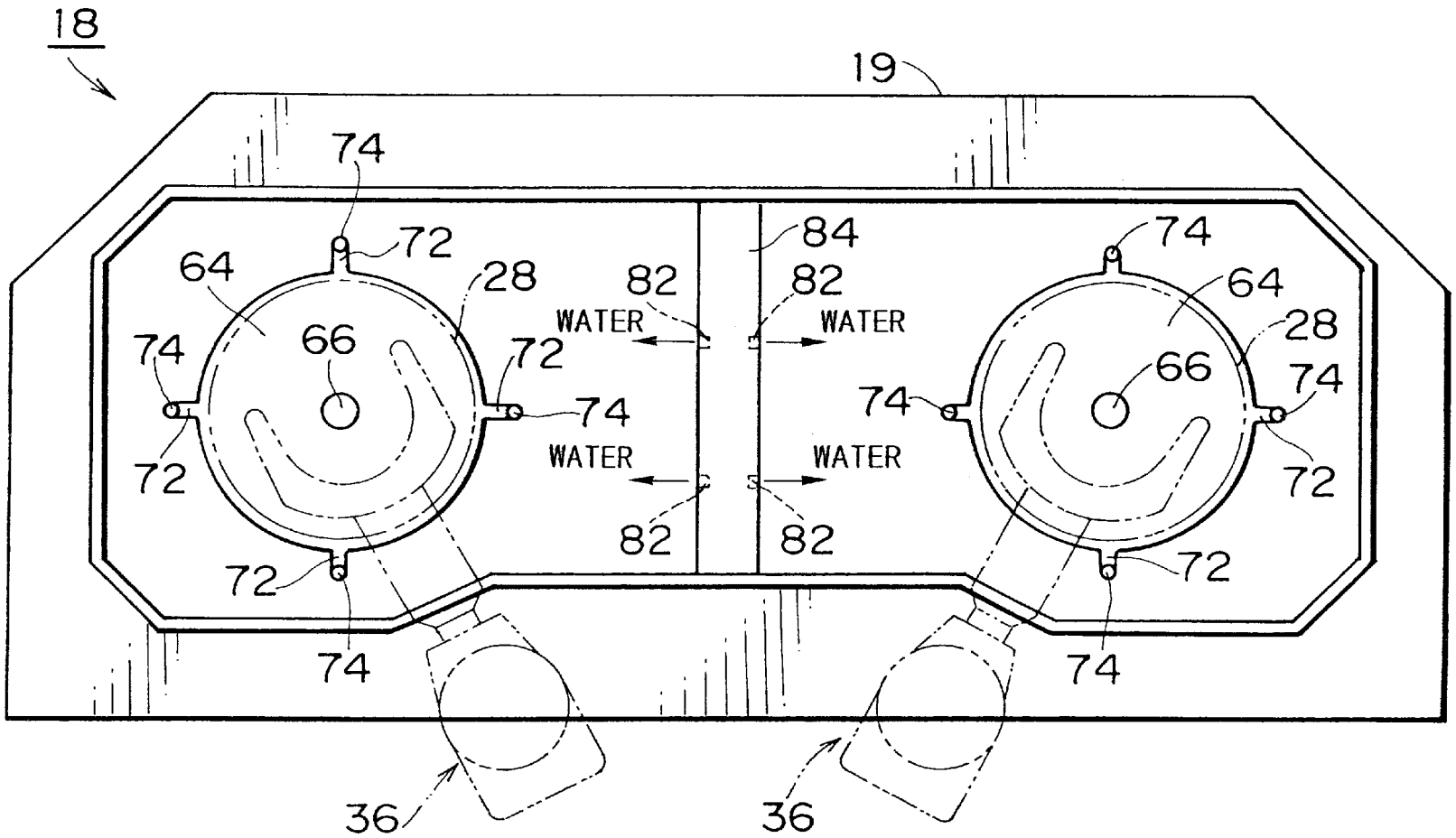
FIG. 2 is a plan view showing a load stage applied to the wafer machining apparatus in FIG. 1.
Figure 3:
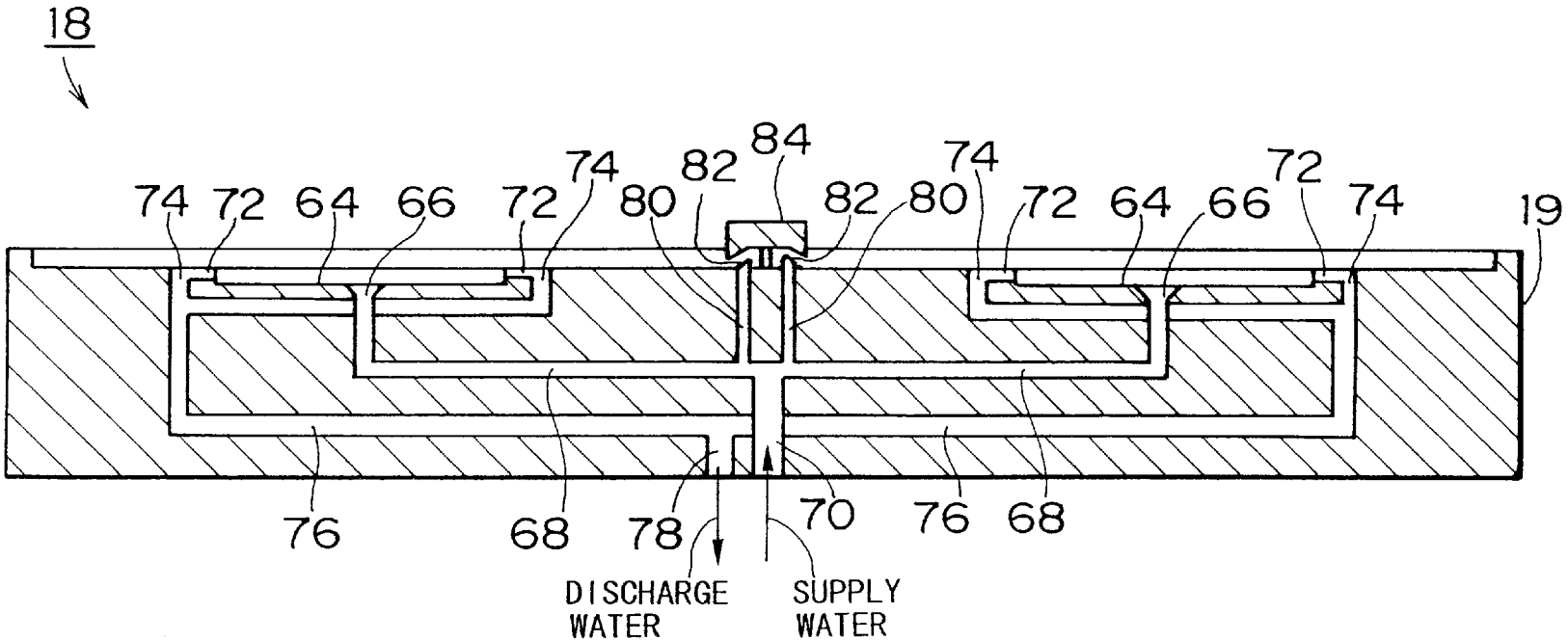
FIG. 3 is a sectional view showing the load stage in FIG. 2.

The load stage 18 temporarily stocks the wafers 28, which have been centered by the alignment part 16, just before the start of the polishing. As shown in FIGS. 2 and 3, circular concave parts 64 are formed at a predetermined interval at the top of a stage body 19 of the load stage 18. The circular wafers 28 transferred by the transfer robot 36 are placed in the concave parts 64. The diameter of the concave parts 64 is a little larger than the diameter of the wafers 28, and the depth of the concave parts 64 is a little larger than the thickness of the wafers 28. Thus, the wafers 28 placed in the concave parts 64 are never displaced, and the entire wafers 28 can be contained in the concave parts 64. Thus, the centered wafers 28 can be held on the load stage 18. The load stage 18, which is arranged just in front of the wafer polishing part 20, holds the centered wafers 28, so that the wafer polishing part 20 can uniformly polish the surfaces of the wafers 28.

If the wafers 28 continue to remain in the concave parts 64, a chuck (equivalent to a wafer holding part) of the wafer polishing part 20 cannot hold the wafers 28 by suction. That is because a holding surface (the bottom) of the chuck collides with the top of the stage body 19 before coming into contact with the wafer 28. The depth of the concave parts 64 is preferably larger than the thickness of the wafers 28 in order to hold the centered wafer 28. On the other hand, the depth of the concave parts 64 is preferably smaller than the thickness of the wafers 28 in order to hold the wafers 28 by the chuck. Thus, there is a conflict between the two ideas.

To address this problem, the load stage 18 of this embodiment is provided with a floating mechanism (equivalent to a floating means) for floating the wafer 28. The floating mechanism floats the wafer 28 in such a manner that the top of the wafer 28 can slightly project from the top of the stage body 19. Consequently, the load stage 18 of this embodiment can prevent the displacement of the wafer 28 and hold the wafer 28 by the chuck.

The floating mechanism of this embodiment jets pure water (equivalent to a liquid) to the concave parts 64 from the bottom thereof. More specifically, jet openings 66 are formed at the center of the bottom of the concave parts 64, and as shown in FIG. 3, the jet openings 66 connect to a feed pump (not shown) through sub lines 68, a master line 70 and a regulatol. The regulator regulates the water feed amount so that the wafer 28 can float appropriately. Lines 80 are extended vertically from the master line 70. Jet openings 82 of the lines 80 are formed at the top of the stage body 19. A rectifier plate 84 is provided above the jet openings 82. The rectifier plate 84 guides pure water (equivalent to a cleaning liquid) jetted from the jet openings 82 toward the concave parts 64. Thus, the pure water jetted from the jet openings 82 flows on the top of the floated wafer 28, and hence, the dust adhering to the top of the wafer 28 or the dust, which is likely to adhere to the top of the wafer 28, can be washed away. Therefore, the chuck holds the clean wafer 28 by suction.

Figure 4:
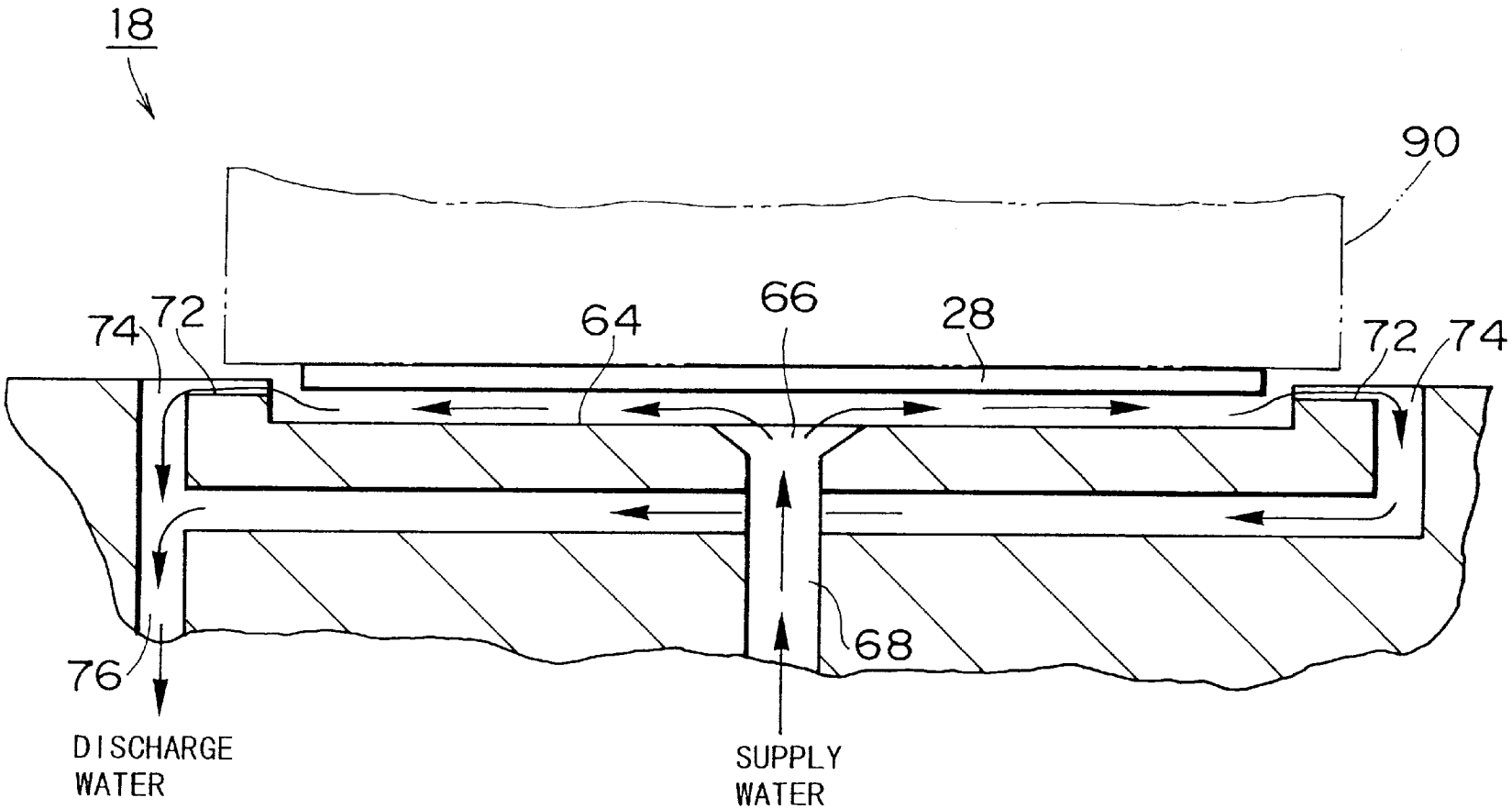
FIG. 4 is an enlarged sectional view showing the essential parts of the load stage in FIG. 2.

As indicated by an arrow in FIG. 4, the pure water jetted from the jet openings 66 flows into exhaust ports 74 via water channels 72. The water channels 72 and the exhaust ports 74 are formed at intervals of 90° at the circumference of the concave parts 64. As shown in FIG. 3, the pure water which has flown into the exhaust ports 74 is discharged to the outside of the load stage 18 through sub lines 76 and a master line 78 formed on the stage body 19. The pure water jetted from the jet openings 82 is discharged by the same route.

The wafer polishing part 20 in FIG. 1 is comprised mainly of four chucks (equivalent to a wafer holding part) 90, 92, 94, 96 and two polishing stages 98, 100.

The chucks 90, 92 are disposed at a predetermined interval on a supporting member 104, and the chucks 94, 96 are disposed at a predetermined interval on a supporting member 106. The supporting structure for the chucks 94, 96 is the same as the supporting structure for the chucks 90, 92, and thus, a description will only be given of the supporting structure for the chucks 90, 92.

Figure 5:
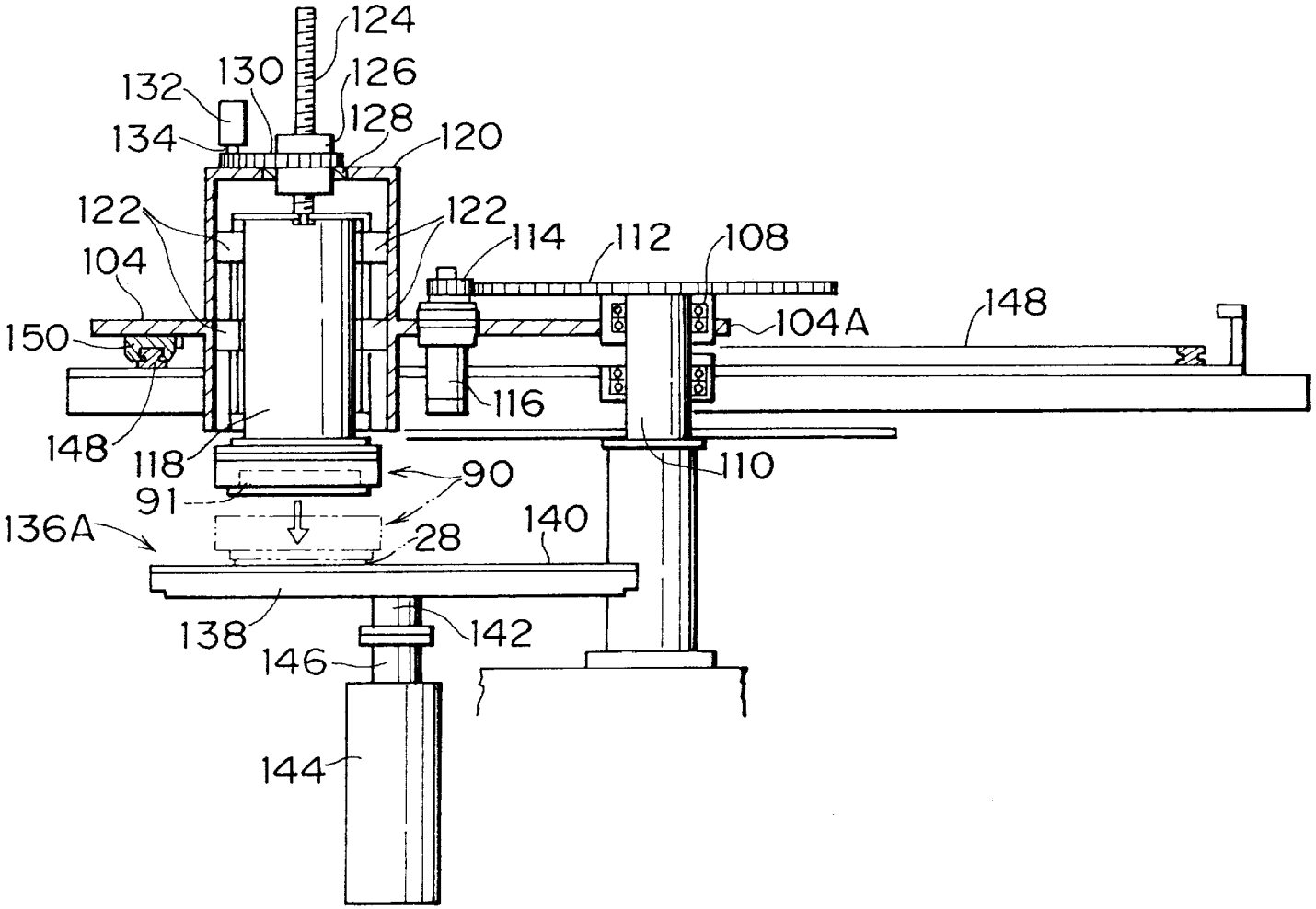
FIG. 5 is a sectional view showing the essential parts of a wafer polishing part of the wafer machining apparatus in FIG. 1.

The supporting member 104 is a fan-shaped, and a base 104A of the supporting member 104 is rotatably supported on a shaft 110 through a bearing 108 as shown in FIG. 5. As shown in FIG. 1, the load stage 18, the polishing stages 98, 100 and the unload stage 22 are arranged at regular intervals around the shaft 110. Rotating the supporting member 104 about the shaft 110 positions the chucks 90, 92 on the load stage 18, the polishing stages 98, 100 and the unload stage 22.

The shaft 110 has a gear 112, which is fixed coaxially with the shaft 110. The gear 112 is engaged with a gear 114, which is attached to an output shaft of a motor 116 fixed on the supporting member 104. If the motor 116 rotates the gear 114, the gear 114 revolves around the gear 112 while rotating. A revolution force of the gear 114 is transmitted to the supporting member 104, which rotates about the shaft 110 within a horizontal plane.

As shown in FIG. 5, the chuck 90 is attached to an output shaft of a motor 118, and is rotated by a driving force of the motor 118. The motor 118 is supported in a casing 120 provided on the supporting member 104 through a plurality of direct-acting guides 122 in such a manner as to freely move vertically. A screw rod 124 is vertically attached to the top of the motor 118, and the screw rod 124 is engaged with a nut member 126. The nut member 126 is mounted in an opening at the top of the casing 120 in such a manner as to freely rotate by means of a bearing 128. An endless belt 130 is wound on the outer peripheral surface of the nut member 126. The belt 130 is wound on a pulley (not shown), which is attached to an output shaft 134 of a motor 132 disposed on the casing 120. If the driving force is transmitted from the motor 132 to the nut member 126 through the belt 130 to rotate the nut member 126, the chuck 90 moves vertically with the motor 118 due to the feeding operation of the nut member 126 and the screw rod 124 and the direct-acting operation of the direct-acting guides 122. Therefore, if the chuck 90 is moved down, the wafer 28 held on the chuck 90 can be polished in the state of being pressed against turntables 136A, 136B.

The turntable 136A is composed of a rotary plate 138 and a polishing pad 140 provided on the rotary plate 138. A shaft 142 projects at the center of the bottom of the rotary plate 138. The shaft 142 connects to an output shaft 146 of a motor 144. Thus, the turntable 136A is rotated by a driving force of the motor 144. Consequently, the wafer 28 is polished by a rotary motion, which is composed of the rotation of the turntable 136A and the rotation of the chuck 90. Slurry is supplied to the polishing pad 140 from a nozzle (not shown) during the polishing of the wafer 28.

The polishing pad 140 of the turntable 136A polishes the oxide film and primarily polishes the metal film. The polishing pad 140 of the turntable 136B secondarily polishes the metal film. Thus, the wafers 28 coated with the oxide films are only polished by the turntable 136A. The wafers 28 coated with the metal films are primarily polished by the turntable 136A and are secondarily polished by the turntable 136B.

A wafer suction member 91, which is made of porous material, is provided at the bottom of the chuck 90, and the suction member 91 holds the wafer 28 by suction, then the wafer 28 is transferred from the load stage 18 to the polishing stages 98, 100. The wafer 28 is transferred from the polishing stages 98, 100 to the unload stage 22. In another polishing method, the wafer 28 is pressed against the polishing pad 140 while the suction member 91 of the chuck 90 is holding the wafer 28 by suction. In an alternative polishing method, air is jetted from the bottom of the chuck 90 toward the wafer 28 to form a pressure fluid layer between the chuck 90 and the wafer 28, and the wafer 28 is pressed against the polishing pad 140 through the pressure fluid layer. In this polishing method, the machining pressure is not determined by the pressure of the pressure fluid layer, but is determined by the downward movement amount of the chuck 90. In this embodiment, two chucks 90, 92 are attached to one supporting member 104, but three or more chucks may be attached to the supporting member 104 if three or more wafers 18 can be polished at the same time. Three or more turn turntables 136 and three or more supporting members 104, 106 may be provided.

At the wafer polishing part 20 in FIG. 1, an annular guide rail 148 is horizontally provided around the shaft 110. The guide rail 148 is formed outside the stages 18, 22, 98, 100 in such a manner as to enclose the stages 18, 22, 98, 100. A pair of sliding guide blocks 150 provided at the ends of the supporting member 104 is slidably joined to the guide rail 148. Consequently, the supporting member 104 can rotate about the shaft 110 in the state of being supported by the shaft 110 and the guide rail 148.

Figure 6:
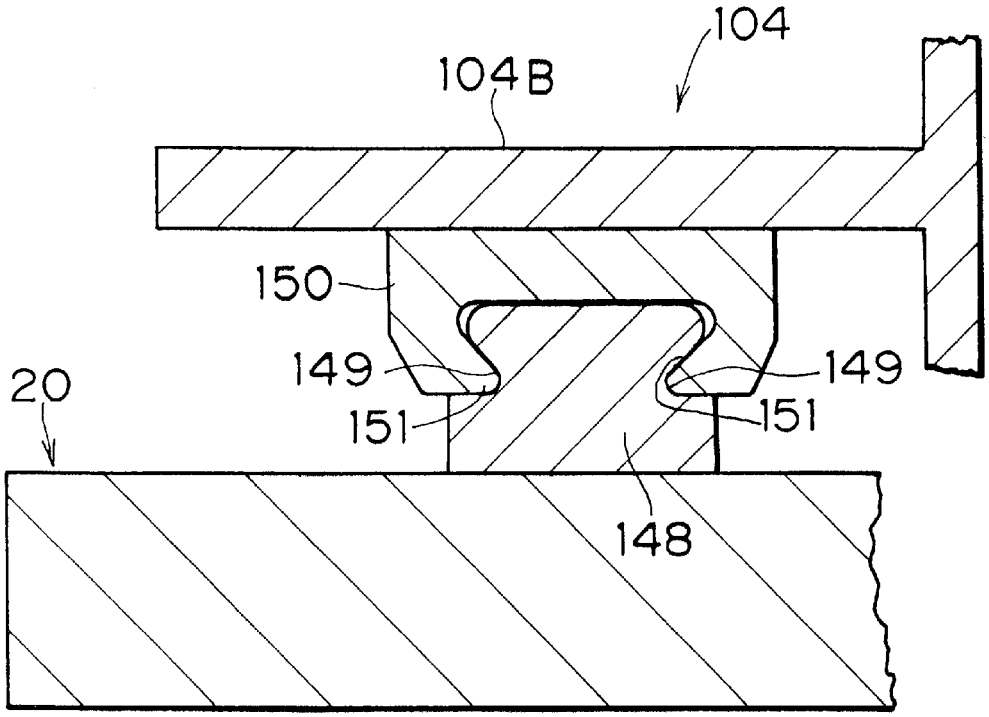
FIG. 6 is a sectional view showing an enlarged sectional view showing a guide rail applied to the wafer machining apparatus in FIG. 1.

As shown in FIG. 6, concave parts 149 are formed along the guide rail 148 at both sides of the guide rail 148. Convex parts 151 of the guide blocks 150 are fitted in the concave parts 149. This regulates the vertical movement of the supporting member 104 and prevents the supporting member 104 from bending.

Figure 7:
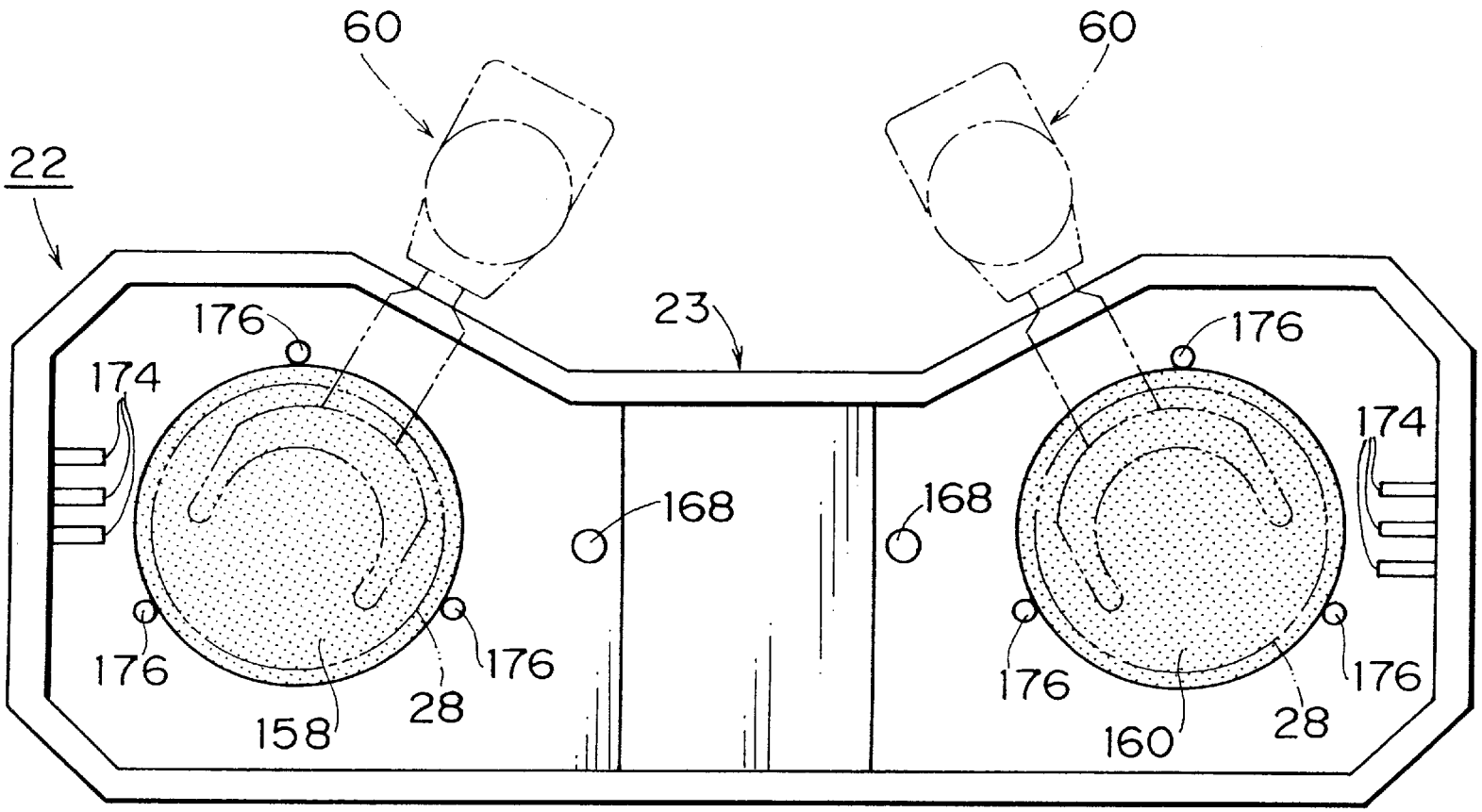
FIG. 7 is a plan view showing an unload stage applied to the wafer machining apparatus in FIG. 1.
Figure 8:
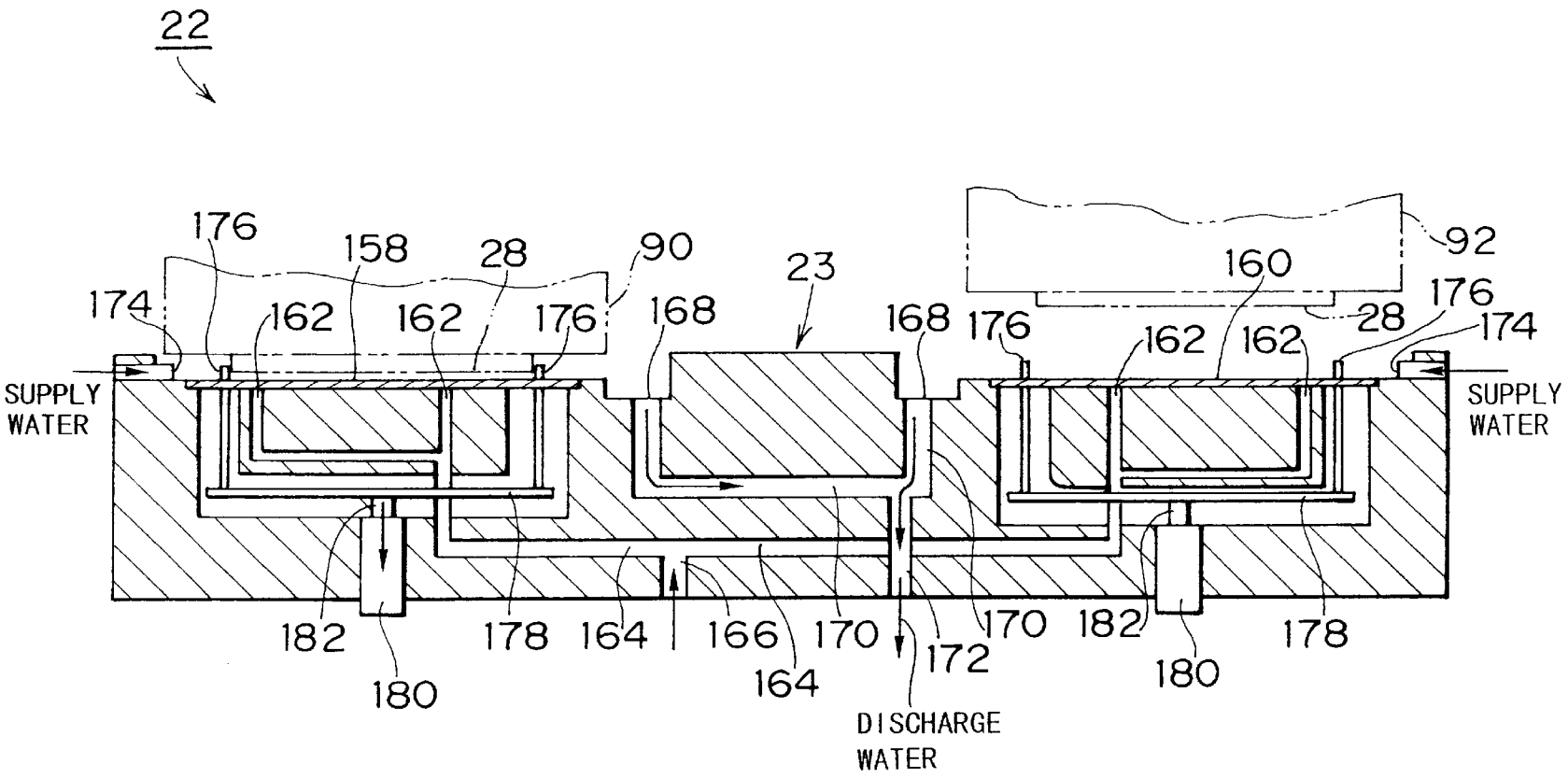
FIG. 8 is a sectional view showing the unload stage in FIG. 7.

FIG. 7 is a plan view of the unload stage 22, and FIG. 8 is a sectional view thereof. The unload stage 22 temporarily receives the polished wafer 28 discharged from the chucks 90–96. Before the wafer 28 is transferred to the cleaning and drying part 24, the unload stage 22 touch-up polishes the wafer 28, and then centers the wafer 28 again.

Polishing pads 158, 160 for the touch-up polishing are detachably attached to the top of a stage body 23 of the unload stage 22. The wafer 28 coated with the metal film requires the touch-up polishing, and the wafer 28 coated with the oxide film does not require the touch-up polishing. To polish the wafer 28 coated with the oxide film, a sponge (e.g., a sponge used for a scrubber) is provided instead of the polishing pads 158, 160.

If the wafer 28 is pressed against the polishing pads 158, 160, the wafer 28 adheres to the polishing pads 158, 160. Therefore, it is difficult to detach the wafer 28 from the polishing pads 158, 160.

To address this problem, the unload stage 22 of this embodiment is provided with a wafer separation mechanism. The wafer separation mechanism of this embodiment supplies pure water from the reverse sides of the polishing pads 158, 160, and has the pure water ooze from the obverse sides of the polishing pads 158, 160, thereby separating the wafer 28 from the polishing pads 158, 160. More specifically, water jet openings 162 are formed on the surface of the stage body 23 provided with the polishing pads 158, 160. As shown in FIG. 8, the water jet openings 162 connect to a feed pump (not shown) through sub lines 164 and a master line 166.

As shown in FIG. 7, a plurality of jet openings 174 is formed at the sides of the polishing pads 158, 160 to jet the pure water, and the jet openings 174 are directed to the polishing pads 158, 160. Thus, the pure water jetted from the jet openings 174 flows on the top of the wafer 28 placed on the polishing pads 158, 160, and this prevents the dust, etc. from adhering to the top of the wafer 28. Consequently, the transfer robot 60 holds the clean wafer 28 by suction.

The pure water oozed from the polishing pads 158, 160 and the pure water jetted from the jet openings 174 flow into an exhaust port 168 formed in the stage body 23. The pure water flown into the discharge port 168 is discharged to the outside of the unload stage 22 through sub lines 170 and a master line 172 formed in the stage body 23.

The unload stage 22 has a positioning mechanism for centering the wafer 28. As shown in FIG. 7, the positioning mechanism is comprised mainly of three positioning pins 176 arranged at regular intervals at the outer circumference of the polishing pads 158, 160. The outer peripheral edge of the wafer 28 comes into contact with the positioning pins 176 to thereby correct the position of the wafer 28 and center the wafer 28.

As shown in FIG. 8, the positioning pins 176 are through the stage body 23 and the bottom ends of the positioning pins 176 are fixed to a supporting plate 178. A rod 182 of a cylinder 180 is fixed at the center of the bottom of the supporting plate 178. If the cylinder 180 expands or contracts the rod 182, the positioning pins 176 are moved vertically between a collapsing position in the stage body 23 and a projecting position indicated by a solid line in FIG. 8.

A control unit (not shown) controls the cylinder 180 in association with the vertical movement of the chucks 90, 92. More specifically, the control unit controls the cylinder 180 in such a manner as to contract the rod 182 when the chucks 90, 92 moves down to press the wafers 28 against the polishing pads 158, 160. Consequently, the wafers 28 are touch-up polished without being disturbed by the positioning pins 176. The control unit also controls the cylinder 180 in such a way as to expand the rod 182 when the chucks 90, 92 move up after the polishing. Consequently, the positioning pins 176 center the wafers 28 on the polishing pads 158, 160. In association with the expansion of the rod 182, the pure water is preferably jetted from the jet openings 162 and the jet openings 174.

The wafers 28, which have been centered at the unload stage 22 and have been separated from the polishing pads 158, 160, are transferred to the cleaning and drying part 24 one by one by the transfer robot 60.

The cleaning and drying part 24 consists of a scrubber 184, a spin cleaner 186 and a spin dryer 188. The wafer 28 held by the transfer robot 60 is transferred to the scrubber 184 first, and the scrubber 184 cleans the wafer 28. Then, the wafer 28 is transferred by a transfer robot 62 from the scrubber 184 to the spin cleaner 186, which cleans the wafer 28. Then, the transfer robot 62 transfers the wafer 28 to the spin dryer 188, which dries the wafer 28. The transfer robot 62 transfers the dried wafer 28 to an alignment part 190, which centers the wafer 28 again and measures the thickness of the wafer 28. Then, the transfer robot 30 holds the wafer 28, which is contained in a predetermined shelf of the cassettes 26A–26D. The information about the thickness measured by the alignment part 190 is used to feedback at the wafer polishing part 20. For example, the polishing time is feedback-controlled in accordance with the information about the thickness. The polishing pad dressing time, the polishing pad exchanging time, and the like are also determined in accordance with the information about the thickness.

A description will now be given of the operation of the wafer machining apparatus 10, which is constructed in the above-mentioned manner.

First, the transfer robot 30 picks up the wafers 28 one by one from predetermined cassettes 26C, 26D, and the wafers 28 are placed on the temporary stage 32. Then, the transfer robot 34 transfers the wafers 28 from the temporary stage 32 to the alignment part 16, which measures the thickness of the wafers 28 and centers the wafers 28.

The transfer robot 36 transfers the centered wafers 28 one by one to the concave parts 64 of the load stage 18.

When two wafers 28 are placed in the concave parts 64, the floating mechanism of the load stage 18 is driven to float the wafers 28 in the concave parts 64. More specifically, the upper surfaces of the wafers 28, which are positioned in the concave parts 64, project from the top of the stage body 19 of the load stage 18. Then, the pure water is jetted from the jet openings 82 of the load stage 18 in association with the floating mechanism. This prevents the dust, etc. from adhering to the top of the wafers 28.

In such a state, the motor 116 is run to rotate the supporting member 104 clockwise from the unload stage 22 to a position above the load stage 18. Then, the chucks 90, 92 are moved down so that the first wafer 28 can be held by the chuck 90 and the second wafer 28 can be held by the chuck 92.

At this time, the top of the two wafers 28, which are centered by the floating mechanism of the load stage, project from the top of the stage body 19 of the load stage 18. Therefore, the chucks 90, 92 can hold the two wafers 28, which are surely centered thereby. The pure water of the floating mechanism presses the wafers 28 upward, and therefore, the wafers 28 are pressed against the chucks 90, 92. This causes the chucks 90, 92 to hold the wafers 28 satisfactorily. Moreover, the pure water improves the water retentivity of the wafers 28.

When the chucks 90, 92 hold the wafers 28, the motor 116 is run to rotate the supporting member 104 clockwise from the load stage 18 toward a position above the polishing stage 98. The turntable 136A of the polishing stage 98 starts polishing the wafers 28.

If the wafers 28 are coated with oxide films, the polishing is finished at the polishing stage 98. If the wafers 28 are coated with the metal films, the primary polishing is performed at the polishing stage 98.

A description will now be given of the wafers 28 coated with the metal film. On completion of the primary polishing at the polishing stage 98, the motor 116 is run to rotate the supporting member 104 clockwise from the polishing stage 98 to a position above the polishing stage 100. The turntable 136B of the polishing stage 100 starts the secondary polishing for the wafers 28. At this time, the chucks 94, 96 hold the third and fourth wafers 28, which are primarily polished by the turntable 136A of the polishing stage 98.

On completion of the secondary polishing, the motor 116 is run to rotate the supporting member 104 clockwise from the polishing stage 100 to a position above the unload stage 22. The secondarily-polished wafers 28 are transferred to the unload stage 22, and the polishing pads 158, 160 touch-up polish the wafers 28. At this time, the turntable 136B of the polishing stage 100 secondarily polishes the third and fourth wafers 28.

On completion of the touch-up polishing, the wafers 28 are released from the chucks 90, 92. Then, the chucks 90, 92 are moved up from the polishing pads 158, 160, and the positioning pins 176 are projected. Then, the pure water is jetted to the polishing pads 158, 160 from the jet openings 162. Consequently, the wafers 28 on the polishing pads 158, 160 are centered while they are separated from the polishing pads 158, 160.

The chucks 90, 92 having released the wafers 28, are moved toward the load stage 18 in order to receive the next wafers (the fifth and sixth wafers) 28, which have not been machined yet. When the chucks 90, 92 hold the wafers 28, the above-mentioned processing is repeated.

On the other hand, the wafers 28, which have been separated and centered at the unload stage 22, are transferred to the scrubber 184 by the transfer robot 60. The scrubber 184 cleans the wafers 28 with the sponge. The transfer robot 62 transfers the cleaned wafers 28 from the scrubber 184 to the spin cleaner 186. The spin cleaner 186 spin-cleans the wafers 28. Consequently, the polished wafers 28 can be cleaned without fail. The transfer robot 62 transfers the spin-cleaned wafers 28 to the spin dryer 188, which dries the wafers 28. The transfer robot 62 transfers the dried wafers 28 to the alignment part 190. The alignment part 190 centers the wafers 28 again and measures the thickness of the wafers 28, and then, the transfer robot 30 holds the wafers 28 and contains them in the predetermined shelves of the cassettes 26A–26D. That completes the machining of the wafers 28 coated with the metal films.

A description will now be given of the wafers 28 coated with the oxide film. On completion of the polishing at the polishing stage 98, the wafers 28 are transferred to the unload stage 22. More specifically, the drive motor 116 is run to rotate the supporting member 104 clockwise from the polishing stage 98 to the position above the unload stage 22, and then, the wafers 28 are transferred to the unload stage 22. The wafers 28 coated with the oxide films do not have to be touch-up polished, and thus, the wafers 28 are cleaned by the sponge, which is provided instead of the polishing pads 158, 160.

On completion of the cleaning using the sponge, the chucks 90, 92 release the wafers 28. Then, the chucks 90, 92 are moved up from the polishing pads 158, 160, and the positioning pins 176 project. Consequently, the wafers 28 are centered on the sponge. Then, the transfer robot 60 transfers the wafers 28 to the scrubber 184. The subsequent steps are the same as in the case of the wafers 28 coated with the metal films, and thus, the explanation will not be given. The wafers 28 coated with the oxide films are machined in the above-described manner.

As stated above, according to the wafer machining apparatus 10 of the present invention, the floating mechanism of the load stage 18 floats the wafers 28 centered in the concave parts 64, and then, the chucks 90–96 hold the wafers 28 by suction. Thus, the chucks 90–96 can easily hold the centered wafers 28.

In this embodiment, the wafers 28 are floated in the pure water, but the present invention should not be restricted to this. The wafers 28 may also be floated in another liquid, which has no bad influence on the wafers 28. Alternatively, the wafers 28 may be floated in the mixture of a liquid and a gas. If the wafers 28 are floated in a liquid, there is such a possibility that the wafers cannot easily be separated from the concave parts of the load stage due to the operation of the surface tension of the liquid. On the other hand, if the wafers are floated in a liquid including bubbles of a gas (e.g., the air), the wafers can easily be separated from the concave parts of the load stage.

In this embodiment, the wafers 28 are cleaned by the pure water, but they may also be cleaned by another cleaning liquid, which has no bad influence on the wafers 28.

As set forth hereinabove, the wafer machining apparatus of the present invention is provided with the floating means at the load stage, and the floating means floats the positioned wafer in the concave part. Therefore, the wafer holding part can easily hold the positioned wafer.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wafer polishing apparatus comprising:

a polishing part for polishing a wafer;

an aligner for centering an unpolished wafer;

a load stage which has a concave part for holding a wafer that has been centered by the aligner;

transporting means for transporting the wafer from said aligner to the concave part of said load stage;

floating means provided in said concave part for floatable supporting the wafer held thereby; and a wafer holding part for holding the wafer by suction and for removing the wafer floatable supported in the concave part from said load stage and transferring the wafer to said polishing part.

2. The wafer machining apparatus as defined in claim 1, wherein said floating means comprises means for supplying a liquid to said concave part.

3. The wafer machining apparatus as defined in claim 1, wherein said floating means comprises means for supplying a liquid and a gas to said concave part.

4. The wafer machining apparatus as defined in claim 1, wherein said load stage comprises a cleaning liquid supply means for supplying a cleaning liquid to a top side of the wafer floated by the floating means.

* * * * *